US006344803B1

(12) United States Patent
Tsubouchi et al.

(10) Patent No.: US 6,344,803 B1
(45) Date of Patent: Feb. 5, 2002

(54) ROADSIDE RADIO APPARATUS

(75) Inventors: Toshimichi Tsubouchi, Osaka; Satori Matsuoka, Kanagawa, both of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/626,282

(22) Filed: Jul. 25, 2000

(30) Foreign Application Priority Data

Jul. 26, 1999 (JP) ..... 11-210828

(51) Int. Cl.[7] ..... G08G 1/00
(52) U.S. Cl. ..... 340/928; 340/539; 235/384
(58) Field of Search ..... 340/928, 932.2, 340/691.1, 539, 935, 933; 455/447, 446; 235/384, 382, 379; 342/44, 42, 51, 456; 701/117

(56) References Cited

U.S. PATENT DOCUMENTS 5,424,727 A * 6/1995 Shieh ..... 340/928
5,933,096 A * 8/1999 Tsuda ..... 340/928
6,081,718 A * 6/2000 Ando ..... 455/447

FOREIGN PATENT DOCUMENTS

JP 10-28011 6/1998
JP 10-163745 6/1998

* cited by examiner

*Primary Examiner*—Jeffery Hofsass
*Assistant Examiner*—Anh La
(74) *Attorney, Agent, or Firm*—Pearne & Gordon LLP

(57) ABSTRACT

A weather-resistant radio apparatus for use at, for example, a toll booth, for transmitting data to a vehicle-mounted unit and for receiving data therefrom. The apparatus operates in a manner allowing the data transfer to occur without the need for the vehicle to stop. The data could include information for toll collection and other purposes.

12 Claims, 12 Drawing Sheets

ROADSIDE RADIO APPARATUS

BACKGROUND OF THE INVENTION

1. Field of the Invention

The present invention relates to radio apparatus on the a roadside (namely, an on-road unit) that is provided in a non-stop automatic toll collection system and that is operative to transmit data, which is necessary for toll collection, to and receive such data from a vehicle-mounted unit provided on a vehicle.

2. Description of the Related Art

Generally, when a vehicle enters an expressway from an ordinary road, and, conversely, when a vehicle leaves an expressway for an ordinary road, the vehicle should temporarily stop at a tollbooth (in case where an expressway is toll road), and a driver should receive a toll ticket and pay a toll. Thus, many vehicles often queue up back from the front of the tollbooth.

To prevent an occurrence of a queue of vehicles (or traffic congestion) back from the front of a tollbooth, hitherto, there has been proposed a non-stop automatic toll collection system that can collect tolls without temporarily stopping vehicles at a tollbooth.

It is necessary for realizing such a system to perform transmission/reception of data, which is required to collect tolls, between an on-road unit, which is provided on a road, and a vehicle-mounted unit mounted on a vehicle. In this case, a transmitting antenna and a receiving antenna are attached to an on-road unit. Transmission of necessary data for toll collection is performed between an on-road unit and a vehicle-mounted unit. Thus, non-stop toll collection is performed without causing a vehicle to temporarily stop at a tollbooth.

The aforementioned on-road unit is, however, installed outdoors. It is, thus, necessary to prevent this on-road unit from being damaged by wind, rain, sunlight, and dust. Consequently, there has been an immediate demand that the system has protection means for protecting this on-road unit from wind, rain, sunbeams, and dust.

SUMMARY OF THE INVENTION

The present invention is accomplished in view of the aforementioned demand. Accordingly, an object of the present invention is to provide a roadside radio apparatus that can protect a radio device body and an antenna thereof from being damaged by wind, rain, sunlight, and dust, and that shows long-term durability.

According to an aspect of the present invention, there is provided a first roadside radio apparatus for transmitting data, which is necessary for toll collection, to a vehicle-mounted unit mounted on a vehicle and receiving the data therefrom. This roadside radio apparatus comprises a housing, a radio device body accommodated in this housing, and an antenna accommodated in the housing and connected to the radio device body.

With such a configuration, in which the radio device body and the antenna connected thereto are accommodated in the housing, the radio device body and the antenna can be prevented from being damaged by wind, rain, sunlight, and dust. Moreover, a roadside radio apparatus having long-term durability can be provided.

Further, according to a second roadside radio apparatus, which is a modification of the first roadside radio apparatus of the present invention, the housing comprises a base having a radio device body accommodating recess portion and an antenna accommodating recess portion, which are disposed back to back with each other, and using a surface part of the antenna accommodating recess portion as a radio wave reflecting surface, a base cover that covers the radio device body accommodating recess portion of this base and that constitutes a radio device body accommodating portion, which accommodates a radio device body, together with the base, and an antenna cover that covers the antenna accommodating recess portion of the base and that constitutes an antenna accommodating portion, which accommodates an antenna substrate, together with the base.

With such a configuration, in which the radio device body is accommodated in the radio device body accommodating portion consisting of the radio device body accommodating recess portion of the base and the base cover, and in which the antenna is accommodated in the antenna accommodating portion consisting of the antenna accommodating recess portion of the base and the antenna cover, the radio device body and the antenna can be prevented from being damaged by wind, rain, sunlight, and dust. Moreover, a roadside radio apparatus having long-term durability can be provided.

Additionally, electric circuit components of the radio device body can be repaired only by removing the base cover from the base. This enhances the serviceability and assemblability of the apparatus.

Further, according to a third roadside radio apparatus, which is a modification of the second roadside radio apparatus of the present invention, the housing further comprises a radio wave leakage preventing means for preventing radio waves, which are reflected by the radio wave reflecting surface of the base, among radio waves transmitted from the antenna from leaking toward sides of the housing.

With such a configuration, effects similar to those of the first roadside radio apparatus can be obtained. Moreover, among radio waves transmitted from the antenna substrate, the radio waves reflected by the radio wave reflecting portion of the base can be prevented by the radio wave leakage preventing means from leaking to the sides of the housing. Consequently, an occurrence of a phenomenon of diffraction of radio waves can be prevented.

Further, according to a fourth roadside radio apparatus, which is a modification of the third roadside radio apparatus of the present invention, the radio wave leakage preventing means is constituted in such a way as to block a space provided between the antenna, which is accommodated in the antenna accommodating portion, and the radio wave reflecting portion with a radio wave cutoff member for shutting off a radio wave reflected by the radio wave reflecting portion.

With such a configuration, effects similar to those of the first roadside radio apparatus can be obtained. Moreover, radio waves transmitted from the antenna substrate and reflected by the radio wave reflecting portion of the base are shut off by the radio wave cutoff member. Thus, the radio waves can be prevented from leaking to the sides of the housing. Consequently, an occurrence of a phenomenon of diffraction of radio waves can be prevented.

Further, according to a fifth roadside radio apparatus, which is an modification of the fourth roadside radio apparatus of the present invention, the radio wave cutoff member is a radio wave cutoff rib formed in the radio wave reflecting portion of the base.

With such a configuration, effects similar to those of the first roadside radio apparatus can be obtained. Moreover, radio waves transmitted from the antenna substrate and reflected by the radio wave reflecting portion of the base are shut off by the radio wave cutoff rib. Thus, the radio waves can be prevented from leaking to the sides of the housing. Consequently, an occurrence of a phenomenon of diffraction of radio waves can be prevented.

Further, according to a sixth roadside radio apparatus, which is a modification of the second roadside radio apparatus of the present invention, the antenna cover is made of a radio wave transmissive material having good weather-resistance and permittivity.

With such a configuration, effects similar to those of the first roadside radio apparatus can be obtained. Moreover, the antenna cover can be made of a radio wave transmissive material, for example, an ASA resin, which has good weather-resistance and permittivity.

Further, according to a seventh roadside radio apparatus, which is an modification of the second roadside radio apparatus of the present invention, the antenna is constituted by an antenna substrate. Moreover, the antenna accommodating portion has a distance maintaining means for maintaining the distance L between the antenna substrate and the antenna cover at a value at which characteristics of the antenna are optimum.

With such a configuration, effects similar to those of the first roadside radio apparatus can be obtained. Moreover, the distance L between the antenna substrate and the antenna cover can be maintained by the distance maintaining means at a value at which the antenna has optimum characteristics. Thus, variation in the characteristic, that is, axial ratio or bandwidth of this antenna can be reduced.

Further, according to an eighth roadside radio apparatus, which is a modification of the seventh roadside radio apparatus of the present invention, the distance maintaining means is accommodated in the antenna accommodating portion in a state in which the antenna substrate is sandwiched between one of spacers and the other spacer. Moreover, an electrically conductive cushion member is provided in the radio wave cutoff rib. Furthermore, this electrically conductive cushion member is made to abut against the antenna substrate.

With such a configuration, effects similar to those of the first roadside radio apparatus can be obtained. Moreover, because the distance maintaining means is accommodated in the antenna accommodating portion in a state in which the antenna substrate is sandwiched between one of the spacer and the other spacer, the strength of the antenna cover can be increased. Thus, the warpage and deformation of the antenna can be prevented. Moreover, a certain positional relationship between the antenna and the antenna cover can be maintained.

Furthermore, because the antenna substrate is pressed against the antenna-cover-side through the latter spacer by the radio wave cutoff rib, variation in dimensions thereof can be accommodated. Moreover, the distance L between the antenna substrate and the antenna cover can be maintained by this distance maintaining means at a value at which the antenna has optimum characteristics. Thus, variation in the characteristic, that is, axial ratio or bandwidth of this antenna can be reduced.

Further, according to a ninth roadside radio apparatus, which is a modification of the eighth roadside radio apparatus of the present invention, a surface portion of the antenna cover is formed like a sphere, of which radius is R, while an antenna cover facing surface portion of the other spacer is formed as a spherical portion that abuts against the surface portion of the antenna cover.

With such a configuration, effects similar to those of the first roadside radio apparatus can be obtained. Moreover, the strength of the antenna cover can be increased still more.

Furthermore, according to a tenth roadside radio apparatus, which is a modification of the ninth roadside radio apparatus of the present invention, many projections are formed on the antenna cover facing surface portion of the other spacer.

With such a configuration, effects similar to those of the first roadside radio apparatus can be obtained. Moreover, when the antenna cover facing surface portion is brought into contact with and pressed against the antenna cover, many projections are crushed, so that variation in dimensions thereof can be accommodated.

Further, according to an eleventh roadside radio apparatus, which is a modification of the second roadside radio apparatus of the present invention, the base comprises a peripheral wall portion having a base-side mating part, and further comprises a screw hole portion, which is disposed at a place that is more inward than this peripheral wall portion, and a packing receiving portion, which is disposed at a place that is more inward than this screw hole portion. Furthermore, the antenna cover comprises a peripheral wall portion having an antenna-cover-side mating portion, which is aligned with the base-side mating portion when attached to the base, and further comprises a screw seat portion disposed at a place that is more inward than this peripheral wall portion, and a packing holding portion disposed at a place that is more inward than this screw seat portion. Moreover, a waterproof packing is provided in the packing receiving portion. Furthermore, in a state in which the antenna cover is attached to the base by aligning the antenna-cover-side mating portion with the base-side mating portion and by screwing screw members, which are inserted into the screw hole portions, into the screw seat portion, the antenna accommodating portion is shut off from the outside by holding the waterproof packing by means of the packing holding portion.

With such a configuration, effects similar to those of the first roadside radio apparatus can be obtained. Moreover, when the antenna cover is attached to the base by aligning the antenna-cover-side mating portion with the base-side mating portion and screwing the screw members, which are inserted into the screw hole portions, into the screw seat portion, a waterproofing position, at which the packing holding portion holds the waterproof packing, is set in such a manner as to be more inward than a fixing position at which the antenna cover is fixed by the screw members. Thus, the waterproof packing performs the function of preventing water from entering the antenna accommodating portion from the screw hole portions.

Further, according to a twelfth roadside radio apparatus, which is a modification of the second roadside radio apparatus of the present invention, an air escape hole is provided in a surface portion of the base cover, wherein a porous waterproof sheet is provided by being stretched in this air escape hole. Moreover, a mounting seat element is fixed to a front side of the surface portion of the base cover, wherein a notch portion is provided in the mounting seat element. Furthermore, the air escape hole is placed in the notch portion. Further, amounting plate is fixed to the mounting seat element. Moreover, a space provided just above the air escape hole is closed by the mounting plate.

With such a configuration, effects similar to those of the first roadside radio apparatus can be obtained. Moreover, the porous waterproof sheet is provided by being stretched in the air escape hole. Furthermore, the mounting plate is placed just above the air escape hole. Thus, rainwater can be prevented from entering this air escape hole.

Further, according to a thirteenth roadside radio apparatus, which is a modification of the second roadside radio apparatus of the present invention, a recess portion is provided in a surface portion of the base cover. Moreover, a bottom part of the recess portion has an LED display window portion for checking whether or not an LED of the radio device body, which is accommodated in the radio device body accommodating portion. Furthermore, the LED display window is covered with a transparent panel.

With such a configuration, effects similar to those of the first roadside radio apparatus can be obtained. Moreover, it can be checked from this LED display window portion whether or not the LED of the radio device body is turned on. Thus, a user can judge from the outside whether or not a power supply for the radio device body is out of order.

DETAILED DESCRIPTION OF THE PREFERRED EMBODIMENTS

Hereinafter, embodiments of the present invention will be described with reference to the accompanying drawings.

Figure 1:
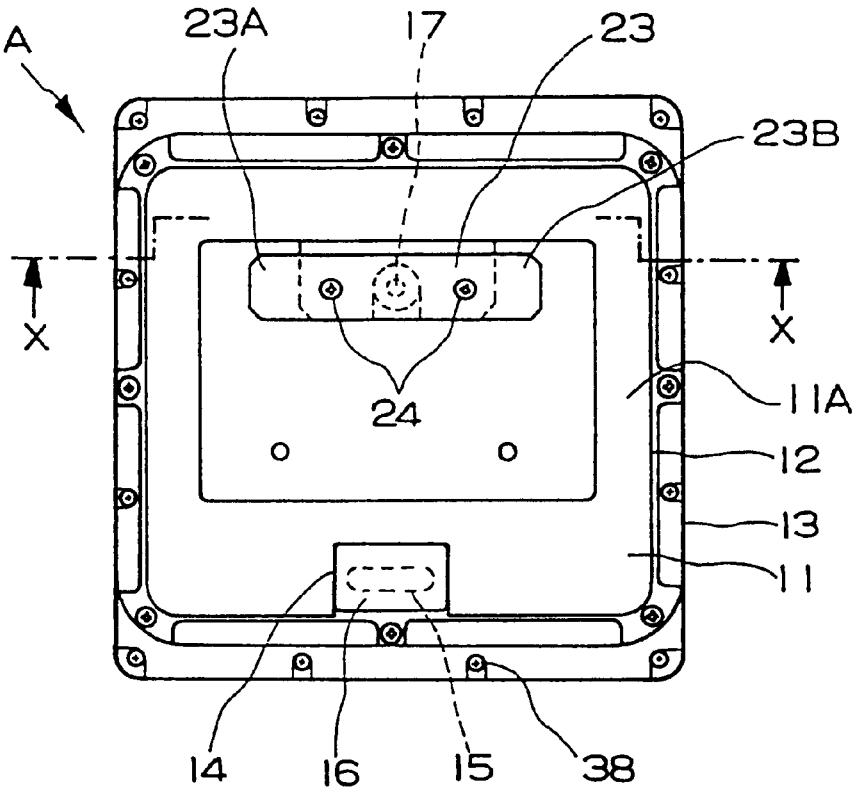
FIG. 1 is a plan view of a roadside radio apparatus of the present invention.
Figure 2:
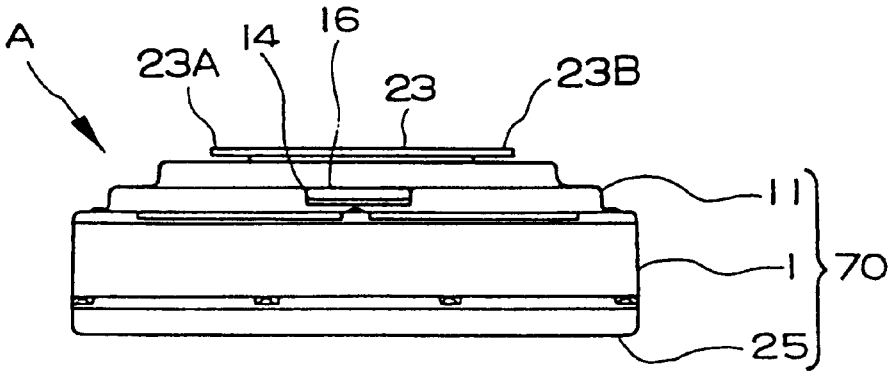
FIG. 2 is a front view of the roadside radio apparatus.
Figure 3:
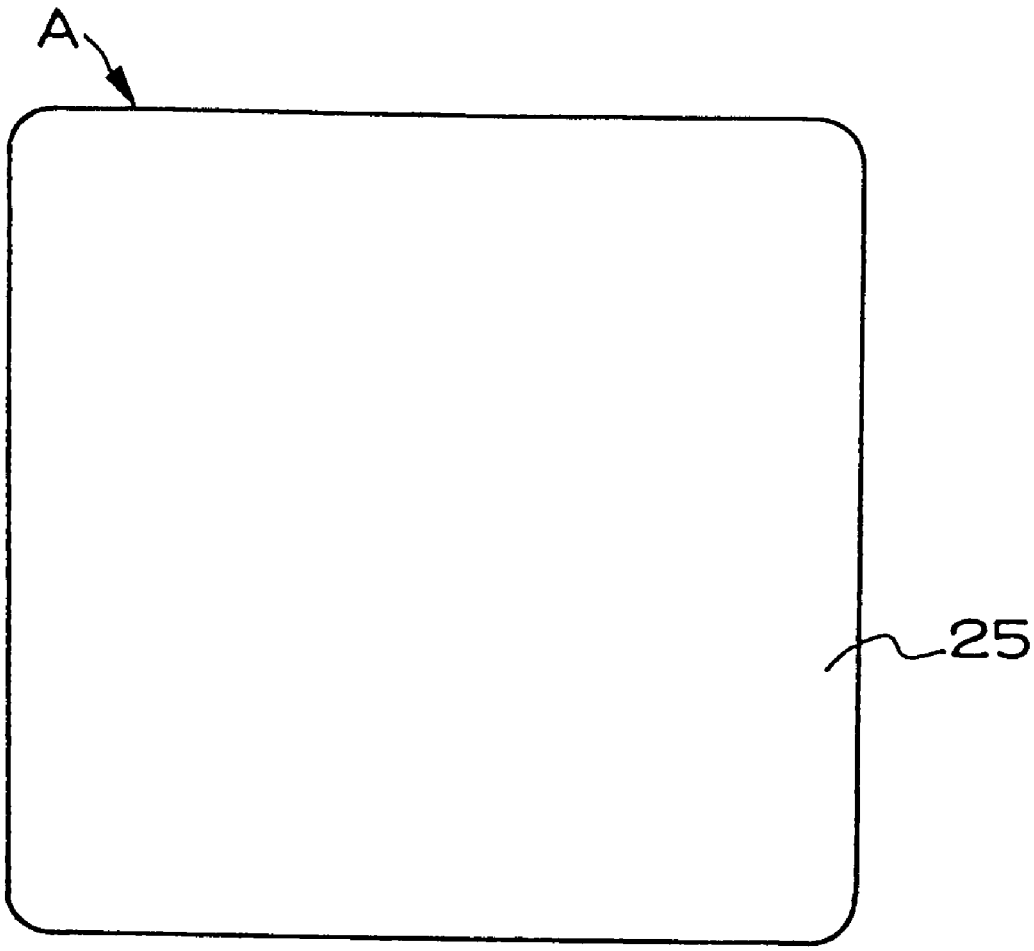
FIG. 3 is a bottom view of the roadside radio apparatus.
Figure 4:
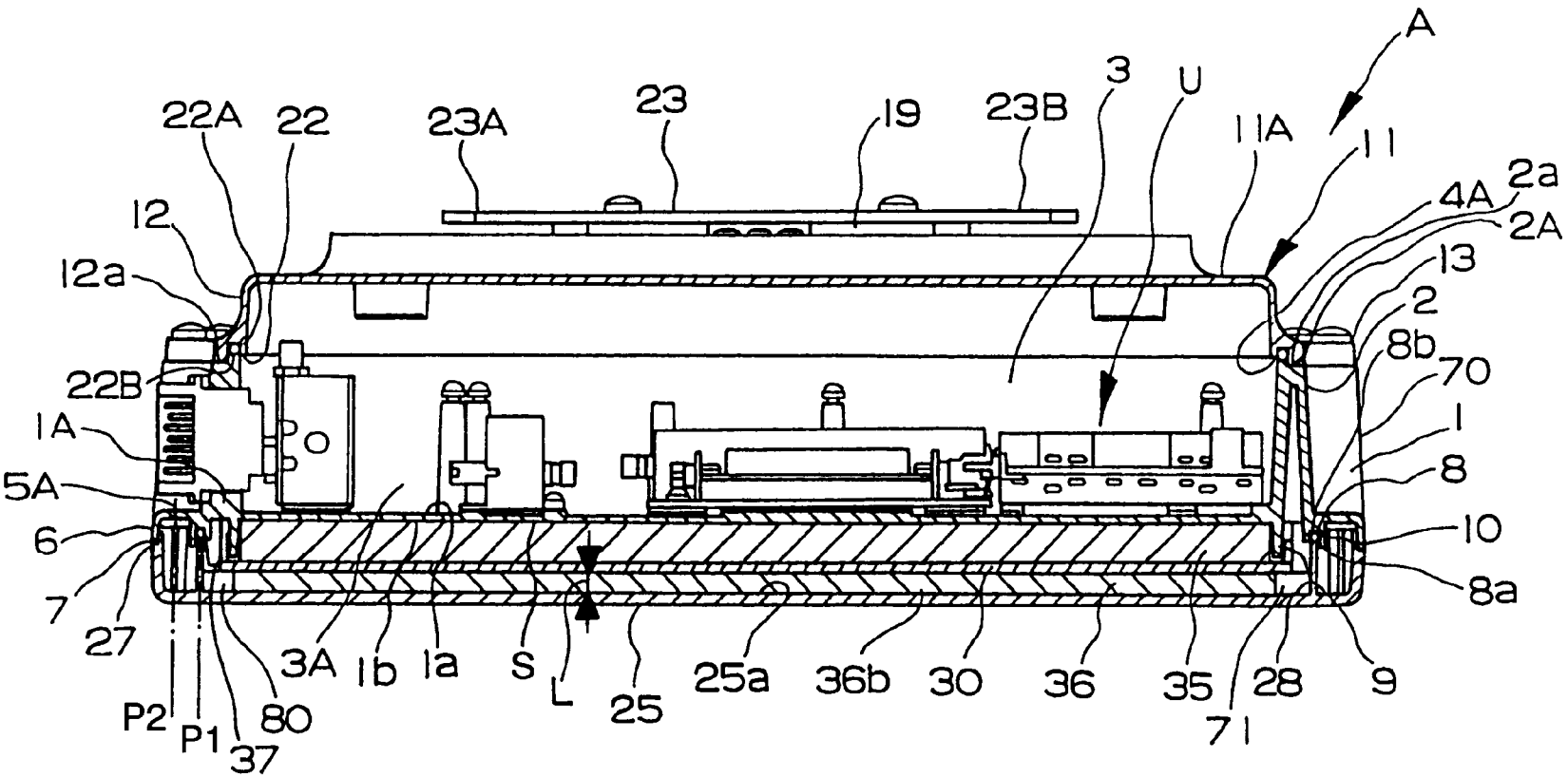
FIG. 4 is a sectional view taken on line X—X of FIG. 1.
Figure 5:
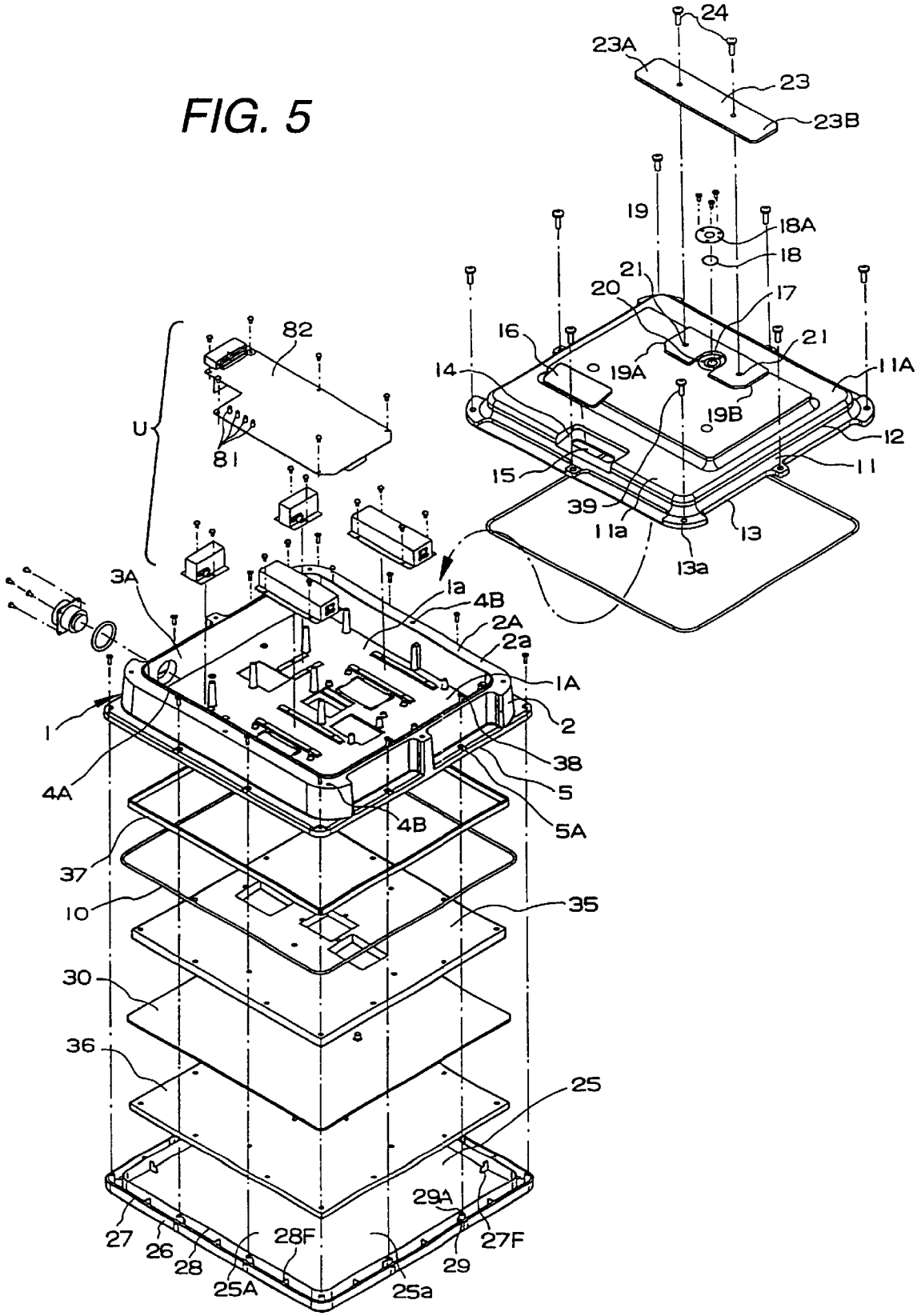
FIG. 5 is an exploded perspective view of the roadside radio apparatus of the present invention.

FIG. 1 is a plan view of a roadside radio apparatus of the present invention. FIG. 2 is a front view of the roadside radio apparatus. FIG. 3 is a bottom view of the roadside radio apparatus. FIG. 4 is a sectional view taken on line X—X of FIG. 1. FIG. 5 is an exploded perspective view of the roadside radio apparatus of the present invention.

As illustrated in FIGS. 1 to 5, the roadside radio apparatus A of the present invention has a housing 70, a radio device body U accommodated in the housing 70, and an antenna substrate (or antenna) 30 accommodated in the housing 70 and connected to the radio device body U. The housing 70 has an aluminum die-cast integral-type base 1, a base cover 11, which covers an upper part of this base 1, and an antenna cover 25 that is attached to a lower portion of the base 1 and made of an ASA resin.

As shown in FIGS. 4 and 5, the base 1 has a base body 1A of a square horizontal section. A square-frame-like peripheral wall portion 2 is formed on one of surface portions (namely, the top surface portion) 1*a* of this base body 1A. A space surrounded by this peripheral wall portion 2 serves as a radio device body accommodating recess portion 3A. A mating part 2A is formed on an end surface part 2*a* of the peripheral wall portion 2. Further, a rib-like packing holding portion 4A is formed over the entire periphery of the mating part 2A. Further, a plurality of screw holes 4B are provided in the mating part 2A of the peripheral wall portion 2 and serve as lid mounting parts. Moreover, a part of one of the surface portions la is established in such a way as to be outer than the peripheral wall portion 2 and serve as a cover attaching part 5. A plurality of screw hole parts 5A are provided in this cover attaching portion 5.

Furthermore, as illustrated in FIG. 4, a peripheral wall portion 6 is formed on the other surface portion (namely, the bottom surface portion) 1*b* of the base body 1A. A space surrounded by this peripheral wall portion 6 serves as an antenna accommodating recess portion 71. A peripheral edge part of this peripheral wall portion 6 serves as a base-side mating part 7. Further, a packing receiving portion 8 is formed on the other surface portion 1*b* of the base body 1A in such a manner as to be placed more inward than and nearly parallel with the peripheral wall portion 6. Moreover, a radio wave cutoff rib 9 is formed on the surface portion 1*b* of the base body 1A in such a manner as to be placed more inward than the packing receiving portion 8 and nearly parallel with the peripheral wall portion 6. Further, a packing fitting groove portion 8*b* is formed in an end surface part 8*a* of the packing receiving portion 8. A waterproof packing 10 is fitted into the packing fitting groove portion 8*b*.

As illustrated in FIGS. 4 and 5, the base cover 11 has a cover body 11A of a square horizontal section. A square-frame-like peripheral wall portion 12 is formed on this cover body 11A. A mating portion 22 is formed on an end surface part 12*a* of the peripheral wall portion 12. A packing fitting groove portion 22A is formed in the mating portion 22. Waterproof packing 22B is fitted into this packing fitting groove portion 22A. Further, a mounting portion 13 having screw inserting hole parts 13*a* is formed on the peripheral edge part of the peripheral wall portion 12. Moreover, a rectangular recess portion 14 is formed in a surface portion 11*a* of the cover body 11A by being placed on a side thereof. An LED display window portion 15 is provided in the bottom portion of this recess portion 14. This LED display window portion 15 is covered with a transparent panel 16.

Further, an air escape hole 17 is provided at a side opposite to the LED display window portion 15 formed in the surface portion 11*a* of the cover body 11A. A porous waterproof sheet 18 is mounted in this air escape hole 17 with a mounting member 18A. A mounting seat element 19 is fixed to the front side of the surface portion 11*a* of the cover body 11A. A U-shaped notch portion 20 and screw portions 21 provided on both sides of this notch portion 20 are formed in this mounting seat element 19. The air escape hole 17 is positioned in the notch portion 20.

Moreover, a mounting plate 23 is put on and fixed to this mounting seat element 19 by screw members 24. The notch portion 20 is covered with this mounting plate 23. A space provided just above the air escape hole 17 is closed by the mounting plate 23. Furthermore, both end portions (namely, left and right end portions) of the mounting plate 23 project outwardly from both end portions (namely, left and right end portions) 19A and 19B of the mounting seat element 19, respectively. These end portions serving as projection portions constitute engaging portions 23A and 23B, respectively.

Further, the base cover 11 covers the radio device body accommodating recess portion 3A of the base 1 and thus constitutes the radio device body accommodating portion 3, which accommodates the radio device body U, together with this base 1. This radio device body accommodating portion 3 contains the radio device body U.

That is, in a state in which the radio device body U is accommodated in the radio device body accommodating recess portion 3A, the base cover 11 is provided along an upper portion of the base 1 by aligning the mating portion 2A of this base 1 with the mating portion 22. The base cover 11 is attached to the base 1 by screwing attaching screw members 39, which are inserted into the screw inserting hole parts 13*a* of the mounting portion 13, into screw holes 4B of the cover attaching portion 5A. In this case, the packing holding portion 4A performs a sealing function by being pressed against the waterproof packing 22B provided in the packing fitting groove portion 22A.

As shown in FIGS. 4 and 5, the antenna cover 25 is made of an ASA resin that is a radio wave transmissive material having high weather-resistance and permittivity. A peripheral wall portion 26 is formed on a peripheral portion of the cover body 25A. The peripheral edge portion of this peripheral wall portion 26 serves as an antenna-cover-side mating portion 27. Further, a rib-like packing holding portion 28 is formed on the inner surface of the cover body 25 in such a way as to be more inward than the peripheral wall portion 26 and nearly parallel thereto. This packing holding portion 28 is connected to the peripheral wall portion 26 through a plurality of connecting ribs 28F.

Figure 10A:
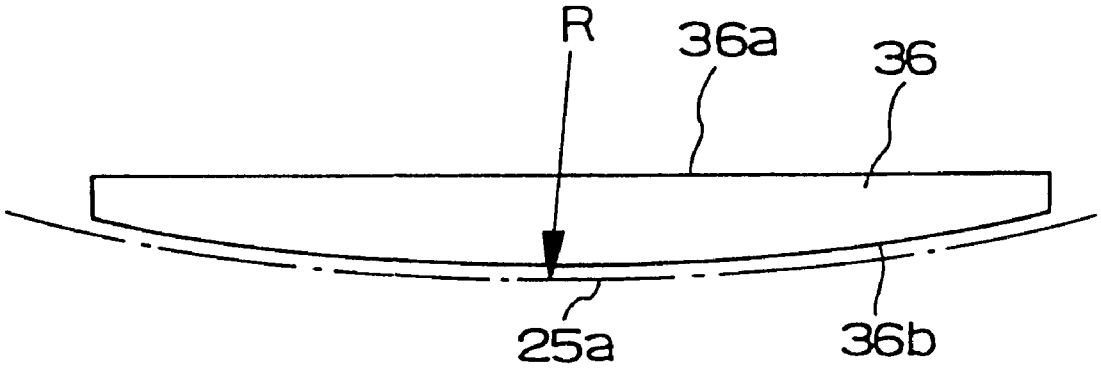
FIG. 10A is a sectional view of a spacer of the roadside radio apparatus of the present invention.

Furthermore, a plurality of antenna substrate receiving portions 27F are formed on an inner surface portion 25*a* of the cover body 25 in such a way as to be more inward than the packing holding portion 28. Further, a plurality of screw seat portions 29 are formed on the inner surface portion 25*a* of the cover body 25A in such a manner as to be outer than the packing holding portion 28 and more inward than the peripheral wall portion 26. A screw hole 29A is formed in each of the screw seat portions 29. Moreover, as shown in FIG. 10A, the inner surface portion 25*a* of the cover body 25A is shaped like a sphere of a radius R.

Furthermore, the antenna cover 25 covers the antenna accommodating recess portion 71 of the base 1 and thus constitutes the antenna accommodating portion 80, which accommodates the antenna substrate 30, together with this base 1.

Figure 6:
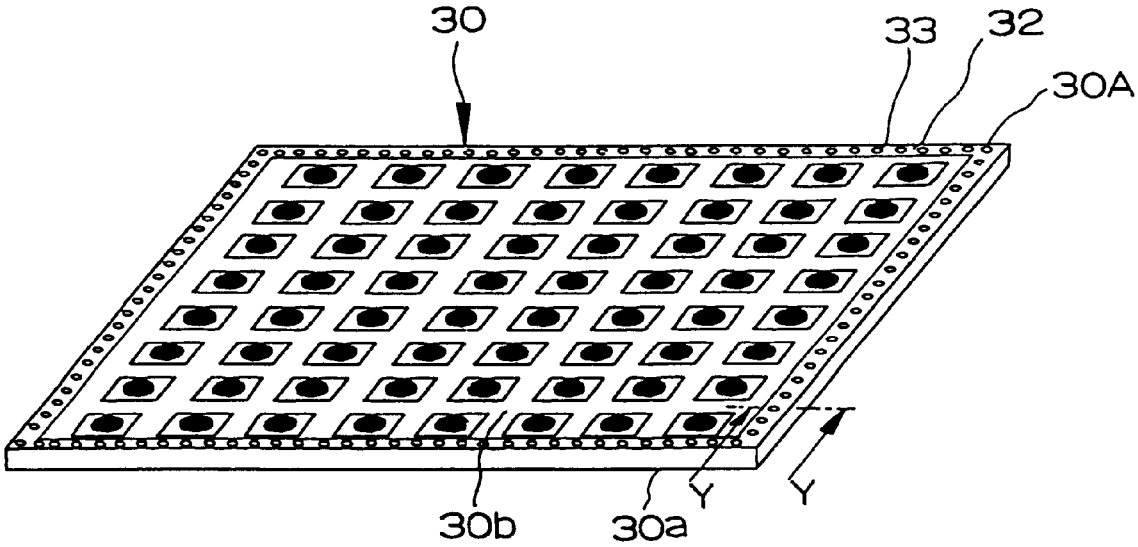
FIG. 6 is a perspective view of an antenna substrate of the roadside radio apparatus.
Figure 7:
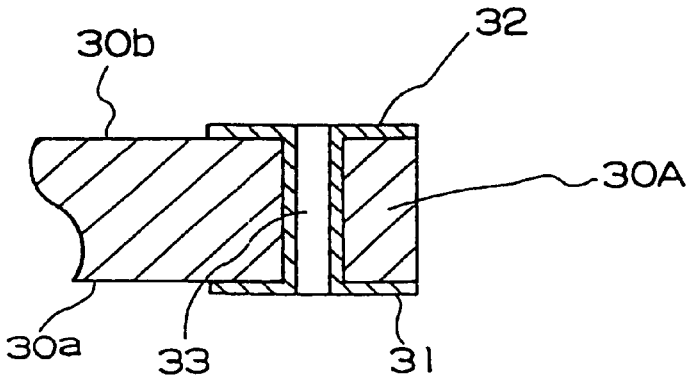
FIG. 7 is a sectional view taken on line Y—Y of FIG. 6.

Further, as shown in FIG. 6, the antenna substrate 30 has a substrate body 30A. Patterns (namely, peripheral through hole patterns) 31 and 32 are provided around the front surface (or bottom surface) 30*a* and the rear surface (or top surface) 30*b* of this substrate body 30A, respectively. Many through holes 33 are provided in these patterns 31 and 32. The patterns 31 and 32 are connected to each other through these through holes 33.

Furthermore, as shown in FIGS. 4 and 5, one of spacers 35 (namely, an upper spacer) is made of a foaming material and shaped in such away as to cover the back-surface side 30*b* (namely, the top-surface side) of the antenna substrate 30.

Further, as shown in FIGS. 4 and 5, the other spacer 36 (namely, a lower spacer) is made of a foaming material and shaped in such a way as to cover the front-surface side 30*a* (namely, the bottom-surface side) of the antenna substrate 30. That is, as shown in FIG. 10A, in the other (or lower) spacer 36, the former surface portion (namely, the top surface portion) 36*a* is formed as a flat surface that abuts against the surface 30*a* of the antenna substrate 30. The other surface portion (or bottom surface portion) 36*b* serving as an antenna cover facing portion is shaped like a sphere of a radius R in such a way as to abut against the spherical inner surface portion 25*a* of a radius R.

Furthermore, in the antenna cover 25, the former and latter spacers 35 and 36 and the antenna substrate 30 are accommodated in a state in which the antenna substrate 30 are sandwiched between the former spacer 35 and the latter spacer 36. The surface portion 36*b* of the latter spacer 36 abuts against the spherical inner surface portion 25*a* of a radius R of the antenna cover 25.

Further, in a state in which an electrically conductive cushion rubber 37 of a U-shaped section is attached to the radio wave cutoff rib 9 of the base 1, the antenna cover 25 is provided along the base 1 by aligning an antenna-cover-side mating portion 27 with the base-side mating portion 7 of this base 1. The antenna cover 25 is attached to the base 1 by screwing attaching screw members 38, which are inserted into the screw inserting holes 5*a* of the cover attaching portion 5A of the base body 1A, into screw holes 29A of the screw seat portion 29 of the antenna cover 25.

In this case, the rib-like packing holding portion 28 of the antenna cover 25 performs a sealing function by touching the waterproof packing 10 provided in the packing fitting groove portion 8*b* of the base 1. Further, the radio wave cutoff rib 9 of the base 1 is placed outside the peripheral edge portion of the former spacer 35. The electrically conductive cushion rubber 37 attached to this radio wave cutoff rib 9 is in contact with the pattern 32 of the peripheral portion of the rear surface 30*b* of the antenna substrate 30.

Thus, in the antenna accommodating portion 80, the former spacer 35 and the latter spacer 36 are accommodated in a state in which the substrate 30 is sandwiched between the spacers 35 and 36. Further, the electrically conductive cushion member 37 is provided in the radio wave cutoff rib 9. Moreover, this electrically conductive cushion member 37 is made to abut against the antenna substrate 30. Consequently, the grounding terminal of the antenna substrate 30 can be brought into contact with the base 1 in a stable condition. Furthermore, the distance between the antenna substrate 30 and the antenna cover 25 can be maintained at a value at which the antenna has optimum characteristics.

Further, in the antenna accommodating portion 80, the former spacer 35 and the latter spacer 36 are accommodated in a state in which the substrate 30 is sandwiched between the spacers 35 and 36. Furthermore, the electrically conductive cushion member 37 is provided in the radio wave cutoff rib 9. Moreover, this electrically conductive cushion member 37 is made to abut against the antenna substrate 30. Thus, a distance maintaining means is constituted.

The distance L between the antenna substrate 30 and the antenna cover 25 can be maintained by this distance maintaining means at a value at which the antenna has optimum characteristics. Thus, variation in the characteristic, that is, axial ratio or bandwidth of this antenna can be reduced.

Further, the inner surface portion 25*a* of the antenna cover 25 is shaped like a sphere of a radius R. The latter surface portion 36*b* serving as an antenna cover facing surface portion of the latter spacer 36 is shaped like a sphere. The latter surface portion 36*b* is made to abut against the inner surface portion 25*a* of the antenna cover 25. Consequently, the strength of this antenna cover 25 can be increased.

Figure 10B:
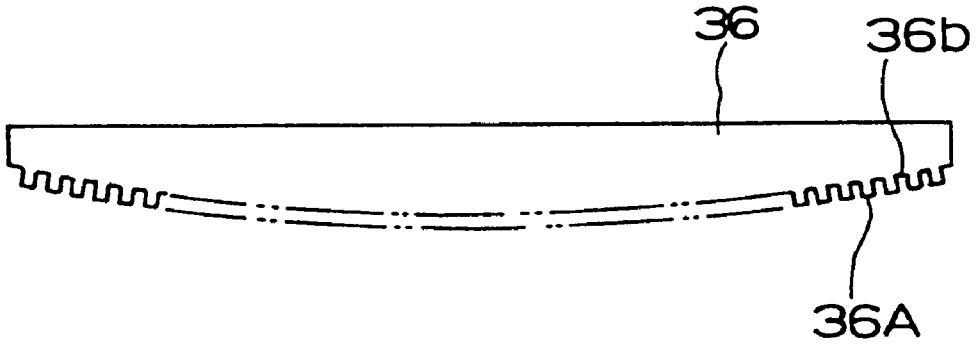
FIG. 10B is a sectional view of another spacer of the roadside radio apparatus of the present invention

Furthermore, as illustrated in FIG. 10B, many projections 36A are formed on the latter surface portion 36*b* of the latter spacer 36. Thus, when the latter surface portion 36*b* is brought into contact with and pressed against the inner surface portion 25*a* of the antenna cover 25, the projections 36A are crushed, so that variation in dimensions thereof can be accommodated.

Further, the latter surface portion (or bottom surface portion) 1*b* of the base body 1A serves as a radio wave reflecting surface (or radio wave reflecting portion) S. Moreover, the rear-surface side 30*b* of the antenna substrate 30 is surrounded by the radio wave cutoff ribs 9.

That is, the housing 70 has a radio wave leakage preventing means for preventing radio waves W, which are reflected by the radio wave reflecting surface S of the base 1, among radio waves transmitted from the antenna substrate 30 from leaking toward the sides of the housing 70.

This radio wave leakage preventing means is constituted by shutting off a space provided between the antenna substrate 30, which is accommodated in the antenna accommodating portion 80, and the radio wave reflecting surface S from the outside with the radio wave cutoff ribs 9 serving as radio wave cutoff members for cutting off the radio waves W reflected by this radio wave reflecting surface S.

Figure 8:
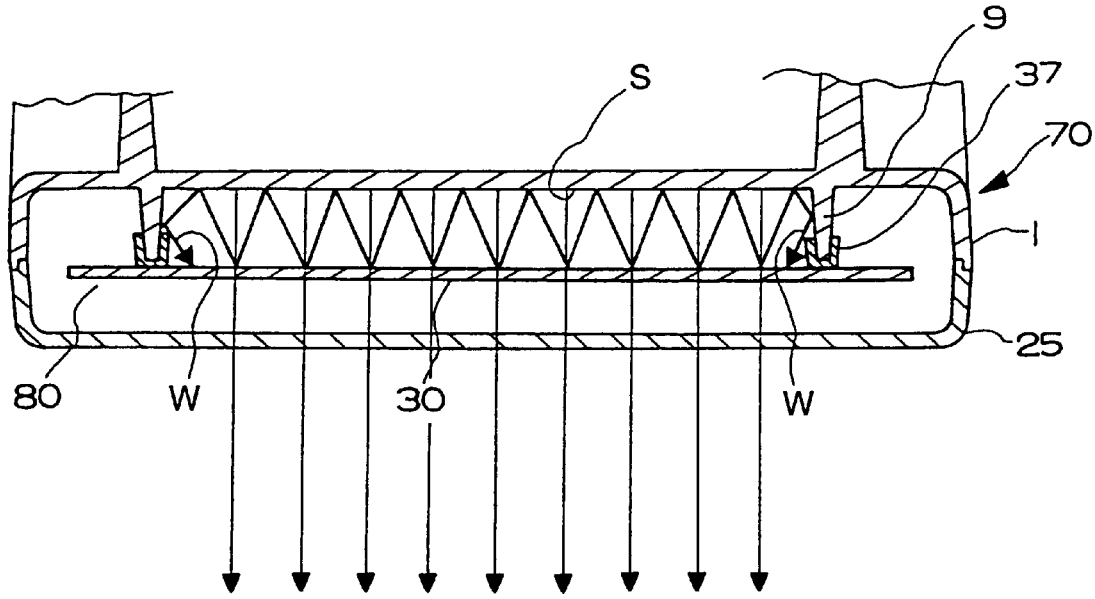
FIG. 8 is a diagram illustrating an operation of a radio wave leakage preventing means of the roadside radio apparatus.
Figure 9:
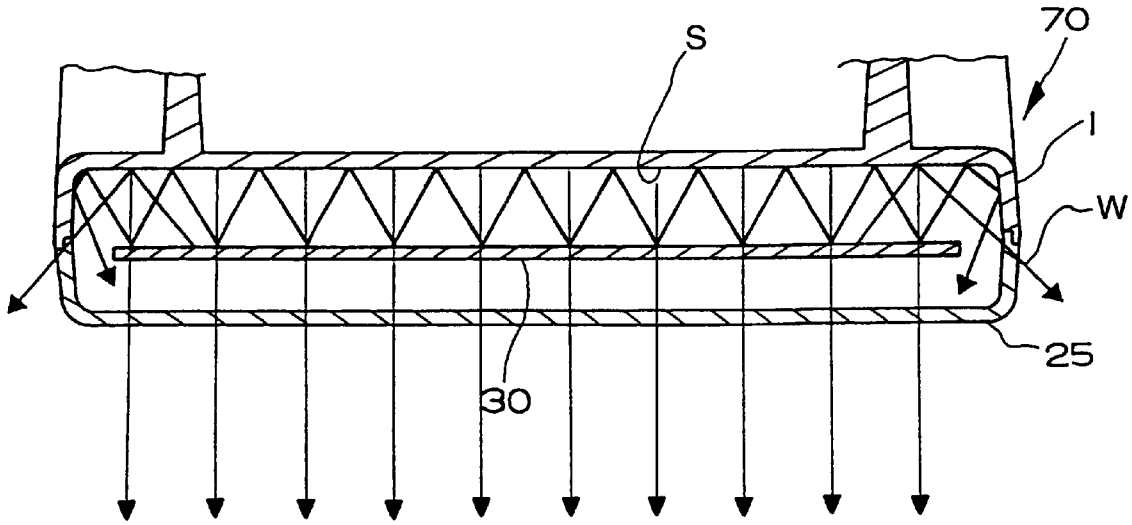
FIG. 9 is a diagram illustrating radio wave leakage.

Owing to the presence of this radio wave leakage preventing means, the radio waves W transmitted from the antenna substrate 30 and reflected by this radio wave reflecting surface S are shut off by the radio wave cutoff ribs 9, as shown in FIG. 8. Thus, the radio waves W can be prevented from leaking to the sides of the housing 70. Consequently, an occurrence of a phenomenon of diffraction of radio waves can be prevented.

When there is no radio wave leakage preventing means, the radio waves W transmitted from the antenna substrate 30 and reflected by this radio wave reflecting surface S are not shut off. Thus, the radio waves leak toward the sides of the housing 70. Consequently, the phenomenon of diffraction of the radio waves is caused.

As described above, the radio device body U and the antenna substrate 30 connected to this radio device body U are accommodated in the housing 70. That is, the radio device body U is accommodated in the radio device accommodating portion 3 constituted by the radio device body accommodating recess portion 3A of the base 1 and the base cover 1. Moreover, the antenna substrate 30 is accommodated in the antenna accommodating portion 80 constituted by the antenna accommodating recess portion 71 of the base 1 and the antenna cover 25. Thus, the radio device body U and the antenna substrate 30 can be prevented from being damaged by wind, rain, sunlight, and dust. Consequently, the present invention can provide a roadside radio apparatus having long-term durability.

Moreover, electric circuit components of the radio device body U can be repaired only by removing the base cover 11 from the base 1. This enhances the serviceability and assemblability of the apparatus.

Further, when the antenna cover 25 is attached to the base 1 by aligning the antenna-cover-side mating portion 27 with the base-side mating portion 7 and screwing the screw members 38, which are inserted into the screw hole portions 5A, into the screw seat portion 29, a waterproofing position P1, at which the packing holding portion 28 holds the waterproof packing 10, is set in such a manner as to be more inward than a fixing position P2 at which the antenna cover 25 is fixed by the screw members 38. Thus, the waterproof packing 10 performs the function of preventing water from entering the antenna accommodating portion 80 from the screw hole portions 5A.

Moreover, the air escape hole 17 is provided in the surface portion 11A of the base cover 11. The porous waterproof sheet 18 is provided by being stretched in this air escape hole 17 by means of a mounting member 18A. The mounting seat element 19 is fixed to the front side of the surface portion 11A of the base cover 11. The notch portion 20 is provided in this mounting seat element 19. The air escape hole 17 is placed in the notch portion 20. The mounting plate 23 is fixed to this mounting seat element 19. The space provided just above the air escape hole 17 is closed by the mounting plate 23. Thus, rainwater can be prevented from entering this air escape hole 17.

Furthermore, the recess portion 14 is provided in the surface part of the surface portion 11A of the base cover 11. The bottom part of this recess portion 14 has the LED display window portion 15 for checking whether or not an LED 81 provided on the printed circuit board 82 of the radio device body U, which is accommodated in the radio device body accommodating portion 3A, is turned on. This LED display window portion 15 is covered with the transparent panel 16. This enables a user to check from this LED display window portion 15 whether or not the LED of the radio device body U is turned on. Thus, a user can judge from the outside whether or not a power supply for the radio device body U is out of order.

Figure 11:
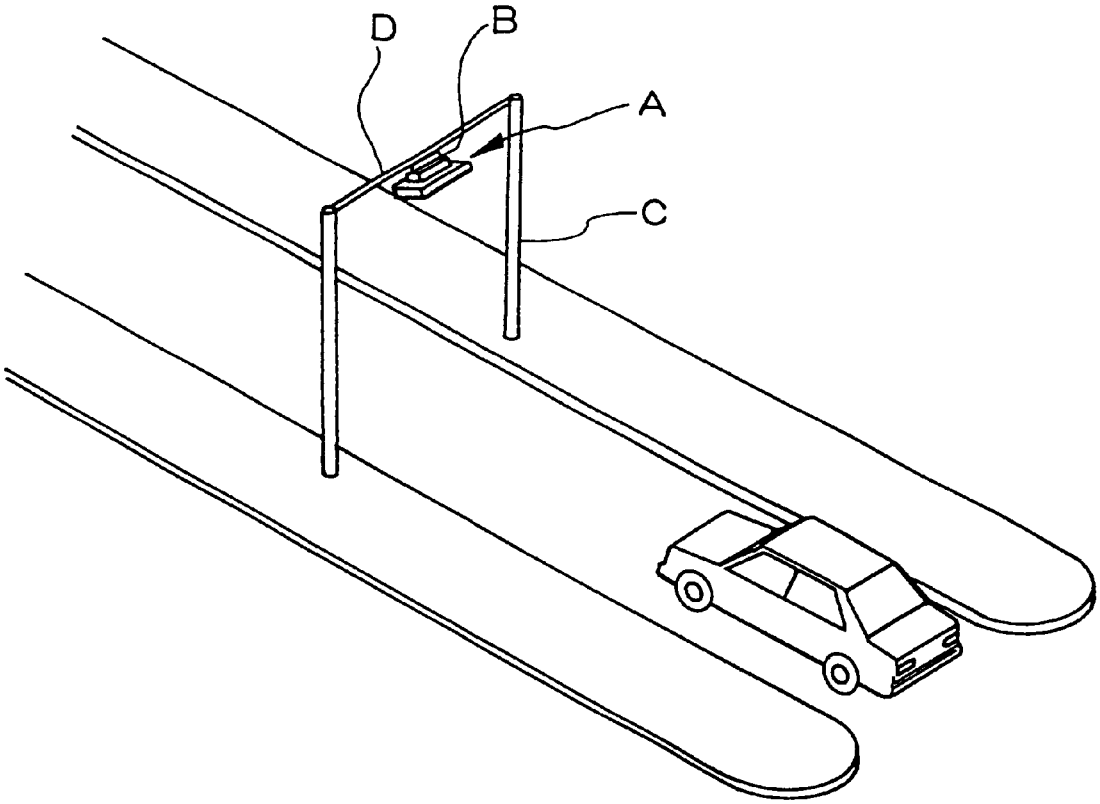
FIG. 11 is a schematic perspective diagram illustrating a state in which the roadside radio apparatus of the present invention is attached to a support.
Figure 12:
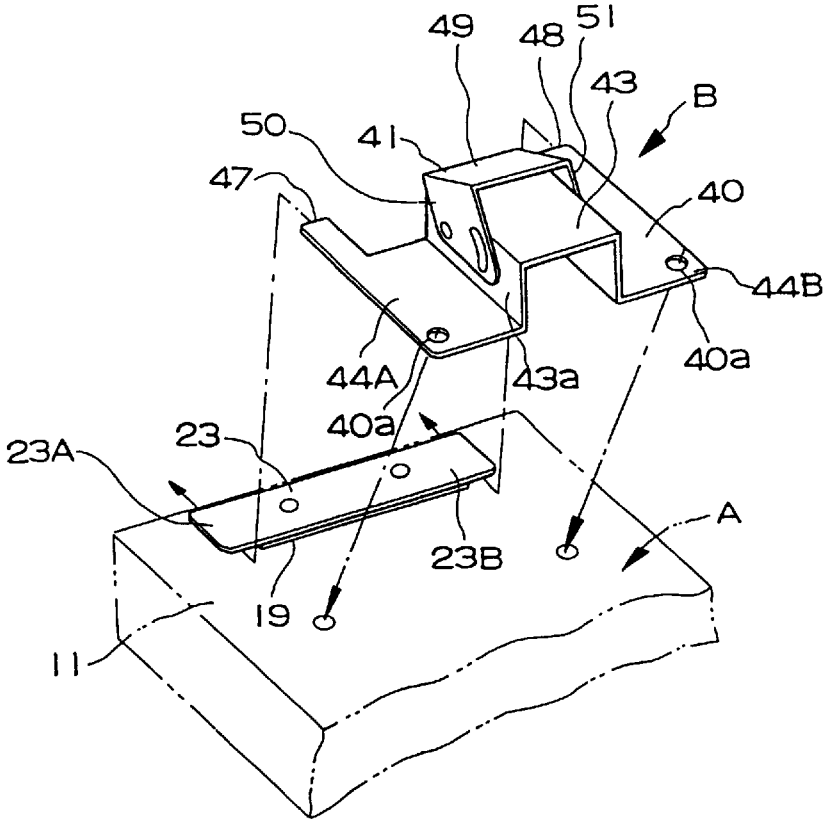
FIG. 12 is a partially cutaway perspective exploded view of a mounting mechanism.

The roadside radio apparatus A constructed as described above is attached to, for example, a lateral member D of a support C by a mounting mechanism (or a fitting) , as illustrated in FIG. 11. This mounting mechanism B is connected to the base cover 11 of the antenna apparatus A.

That is, as illustrated in FIGS. 12 to 18, the mounting mechanism B comprises a mounting plate 23 fixed onto the mounting seat element 19, an insert-mounting member 40, an angular adjusting member 41, and a lateral-member mounting member 42.

The insert-mounting member 40 has a holding portion 43 of a U-shaped section. Mounting plate portions 44A and 44B are formed on both side edge portions of this holding portion 43. Further, a hole portion 45 for a fulcrum, and a fixing hole portion 46 are formed in a side surface portion 43*a* of the holding portion 43. Moreover, inserting portions 47 and 48, which project backwardly, are formed on the left and right rear edge portions of the mounting plate portions 44A and 44B, respectively. Furthermore, the mounting hole portion 40A is provided in each of the mounting plates 44A and 44B.

Figure 13:
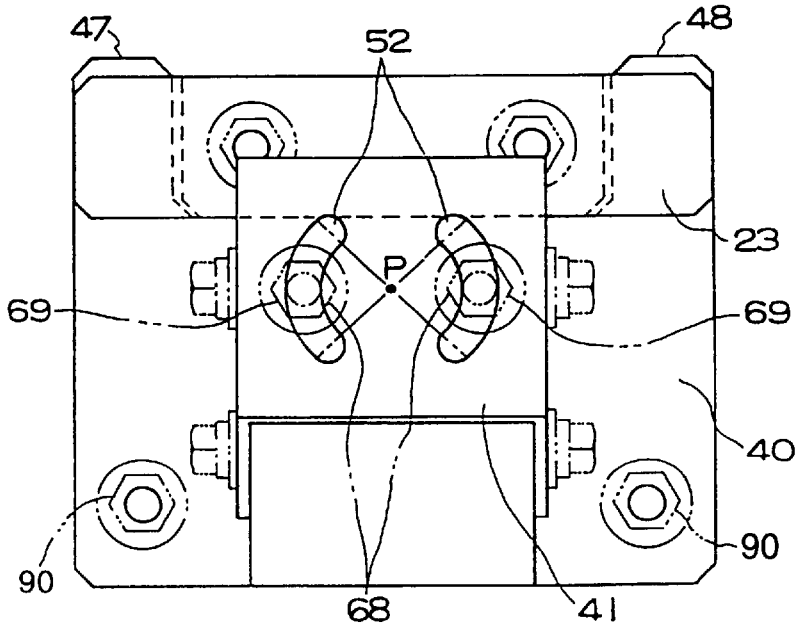
FIG. 13 is a plan view of the mounting mechanism.
Figure 14:
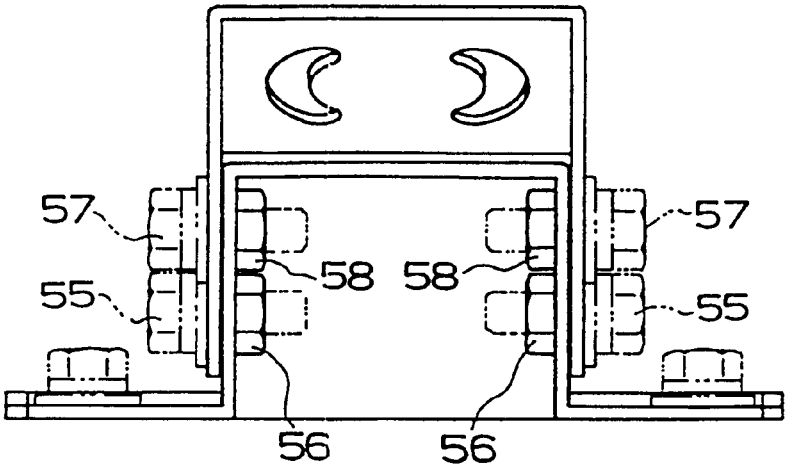
FIG. 14 is a front view of the mounting mechanism.
Figure 15:
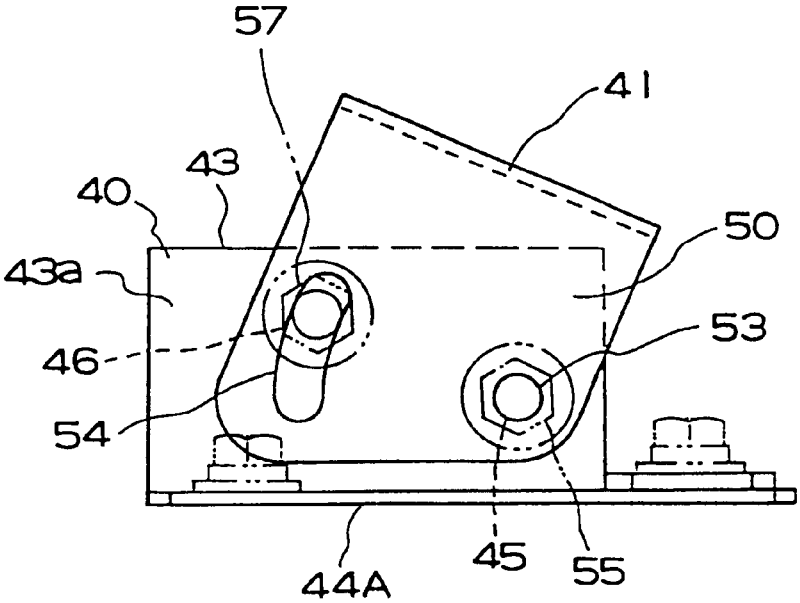
FIG. 15 is a side view of the mounting mechanism.
Figure 16:
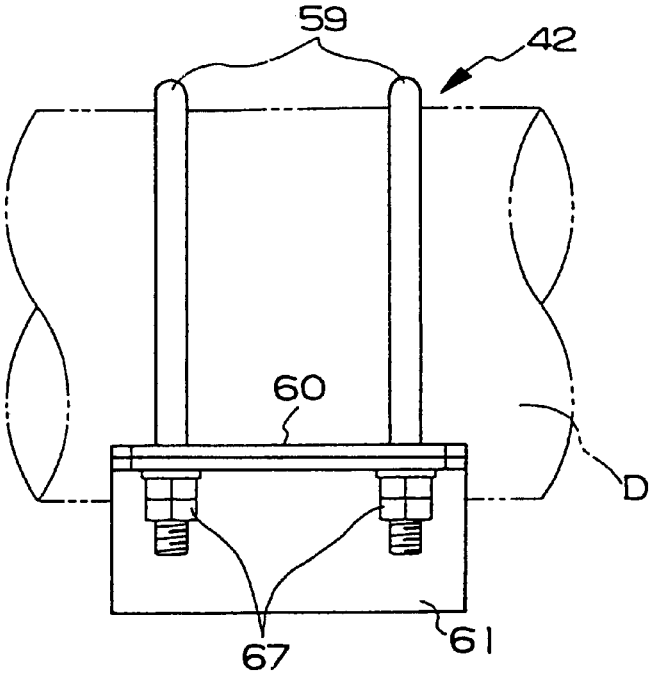
FIG. 16 is a front view of a lateral-member mounting member in the mounting mechanism.
Figure 17:
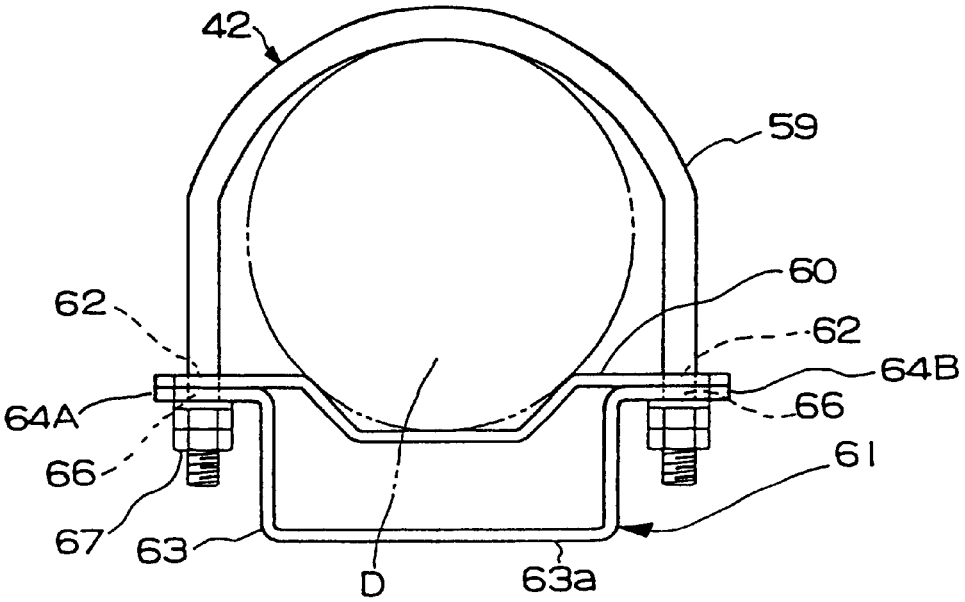
FIG. 17 is a side view of a lateral-member mounting member in the mounting mechanism.
Figure 18:
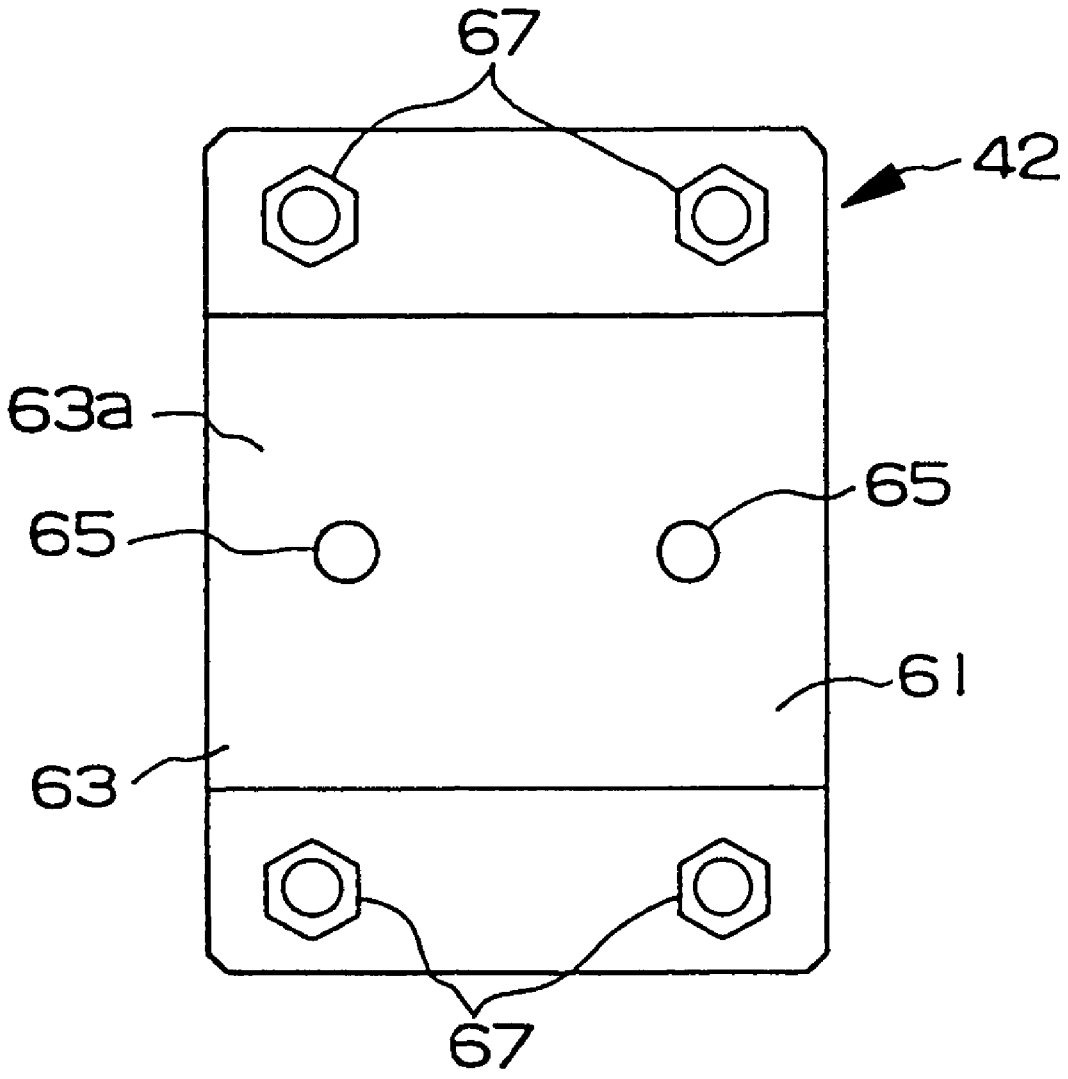
FIG. 18 is a bottom view of a lateral-member mounting member in the mounting mechanism.

Furthermore, the angular adjusting member 41 has a surface portion 49 and side surface portions 50 and 51 each bent perpendicular to this surface portion 49, and also has a U-shaped section. As shown in FIG. 13, a pair of elongated arcuate hole portions 52 each extending along a part of a circle, whose center is located at a point P, are provided in the surface portion 49 in such a manner as to be opposed to each other. Moreover, a hole portion for a fulcrum 53, and an arcuate elongated hole portion 54, which extends along apart of a circle, whose center is located at this hole portion 53, are provided in each of side surface portions 50 and 51.

Further, the hole portions 45 and 53 for a fulcrum are aligned with each other by putting the angle adjusting member 41 on the holding portion 43 of the insert-mounting member 40. Then, a bolt 55 serving as a member for a fulcrum is inserted into these hole portions 45 and 53. Thus, a nut 56 is screwed into this bolt 55. Moreover, a bolt 57 serving as a locking member is inserted into the fixing hole portion 46 from the elongated hole portion 54. Then, a nut 58 is screwed into this bolt 57. Thus, the angle adjusting member 41 is attached to the insert-mounting member 40.

Furthermore, the lateral-member mounting member 42 comprises a U-shaped bolt 59, a clamping member 60, and a holding member 61. The clamping member 60 has inserting holes 62 provided in both side portions thereof. Further, the holding member 61 has a holding portion 63 of a U-shaped section. Mounting portions 64A and 64B each having an inserting hole 66 are formed in both side edge parts of this holding portion 63. A surface part 63*a* of the holding portion 63 has a pair of bolt inserting hole portions 65.

Furthermore, the antenna apparatus A is attached to the lateral member D of the support C by the aforementioned mounting mechanism B. That is, the U-shaped bolt 59 is engaged with the lateral member D. Then, the clamping member 60 and the holding member 61 are attached to this U-shaped bolt 59 by using the inserting holes 62 and 66. The holding member 61 is fixed to the lateral member D through the clamping member 60 and the U-shaped bolt 59 by tightening the nut member 67 screwed into the U-shaped bolt 59.

Then, bolts 68 are inserted into the bolt inserting hole portions 65 of the surface portion 63a of the holding member 61. Further, these bolts 68 are inserted into the arcuate elongated hole portions 52 of the angular adjusting member 41. Then, the nut members 69 are screwed. Furthermore, the insert-mounting member 40 and the angle adjusting member 41 are held by the holding member 61.

Subsequently, the roadside radio apparatus A is lifted. Then, the inserting portions 47 and 48 of the insert-mounting member 40 are inserted under and engaged with the engaging portions 23A and 23B provided at both end portions of the mounting plate 23, which is put on and fixed to the mounting seat element 19 of the base cover 11. Thus, the mounting plate portions 44A and 44B are fixed to the base cover 11 by means of mounting bolts 70 by using the mounting hole portions 40*a*.

As described above, according to the roadside radio apparatus of the present invention, the radio device body and the antenna connected to this radio device body are accommodated in the housing. Thus, the radio device body and the antenna can be prevented from being damaged by wind, rain, sunlight, and dust. Consequently, the present invention can provide a roadside radio apparatus having high long-term durability.

Further, according to the roadside radio apparatus of the present invention, the radio device body is accommodated in the radio device body accommodating portion consisting of the radio device body accommodating recess portion of the base and the base cover. Moreover, the antenna is accommodated in the antenna accommodating portion consisting of the antenna accommodating recess portion of the base and the antenna cover. Thus, the radio device body and the antenna can be prevented from being damaged by wind, rain, sunlight, and dust. Furthermore, a roadside radio apparatus having long-term durability can be provided. Additionally, electric circuit components of the radio device body can be repaired only by removing the base cover from the base. This enhances the serviceability and assemblability of the apparatus.

Moreover, according to the roadside radio apparatus of the present invention, among radio waves transmitted from the antenna substrate, the radio waves reflected by the radio wave reflecting portion of the base can be prevented by the radio wave leakage preventing means from leaking to the sides of the housing. Consequently, an occurrence of a phenomenon of diffraction of radio waves can be prevented.

Further, the radio wave leakage preventing means is constituted in such a way as to block a space provided between the antenna, which is accommodated in the antenna accommodating portion, and the radio wave reflecting portion with a radio wave cutoff member (for instance, a radio wave cutoff rib formed in the radio wave reflecting portion of the base) for shutting off a radio wave, which is reflected by the radio wave reflecting portion, from the outside.

Moreover, according to the roadside radio apparatus of the present invention, the antenna cover can be made of a radio wave transmissive material, for example, an ASA resin, which has good weatherability and permittivity.

Moreover, according to the roadside radio apparatus of the present invention, the distance L between the antenna substrate and the antenna cover can be maintained by the distance maintaining means at a value at which the antenna has optimum characteristics. Thus, variation in the characteristic, that is, axial ratio or bandwidth of this antenna can be reduced.

Moreover, according to the roadside radio apparatus of the present invention, the distance maintaining means can be accommodated in the antenna accommodating portion in a state in which the antenna substrate is sandwiched between one of the spacer and the other spacer. Thus, the strength of the antenna cover can be increased. Consequently, the warpage and deformation of the antenna can be prevented. Moreover, a certain positional relationship between the antenna and the antenna cover can be maintained.

Furthermore, because the antenna substrate is pressed against the antenna-cover-side through the latter spacer by the radio wave cutoff rib, variation in dimensions thereof can be accommodated. Moreover, the distance L between the antenna substrate and the antenna cover can be maintained by this distance maintaining means at a value at which the antenna has optimum characteristics. Thus, variation in the characteristic, that is, axial ratio or bandwidth of this antenna can be reduced.

Further, according to the roadside radio apparatus of the present invention, a surface portion of the antenna cover is formed like a sphere, while an antenna cover facing surface portion of the other spacer is formed as a spherical portion that abuts against the surface portion of the antenna cover. Thus, the strength of the antenna cover can be increased still more. Moreover, many projections are formed on the antenna cover facing surface portion of the other spacer. Thus, when the antenna cover facing surface portion is brought into contact with and pressed against the antenna cover, many projections are crushed, so that variation in dimensions thereof can be accommodated.

Moreover, according to the roadside radio apparatus, when the antenna cover is attached to the base by aligning the antenna-cover-side mating portion with the base-side mating portion and screwing the screw members, which are inserted into the screw hole portions, into the screw seat portion, a waterproofing position, at which the packing holding portion holds the waterproof packing, is set in such a manner as to be more inward than a fixing position at which the antenna cover is fixed by the screw members. Thus, the waterproof packing performs the function of preventing water from entering the antenna accommodating portion from the screw hole portions.

Moreover, according to the roadside radio apparatus of the present invention, the air escape hole is provided in the surface portion of the base cover. The porous waterproof sheet is provided by being stretched in this air escape hole. The mounting seat element is fixed to the front side of the surface portion of the base cover. The notch portion is provided in this mounting seat element. The air escape hole is provided in the notch portion. The mounting plate is put on and fixed to this mounting seat element. The space provided just above the air escape hole is closed by the mounting plate. Thus, rainwater can be prevented from entering this air escape hole.

Moreover, according to the roadside radio apparatus of the present invention, a recess portion is provided in the surface portion of the base cover. Furthermore, a bottom part of this recess portion has an LED display window portion for checking whether or not an LED of the radio device body, which is accommodated in the radio device body accommodating portion. Furthermore, this LED display window is covered with a transparent panel. Thus, it can be checked from this LED display window portion whether or not the LED of the radio device body is turned on. Consequently, a user can judge from the outside whether or not a power supply for the radio device body is out of order.

While only a certain embodiment of the invention has been specifically described herein, it will be apparent that numerous modifications may be made thereto without departing from the spirit and scope of the invention.

The present invention is based on Japanese Patent Application No. Hei. 11-210828 which is incorporated herein by reference.

What is claimed is:

1. A radio apparatus for transmitting data to a vehicle-mounted unit mounted on a vehicle and receiving data therefrom, said data being for toll collection, said radio apparatus comprising:

a housing comprising:

a base comprising a radio device body accommodating recess portion; and an antenna accommodating recess portion; wherein the radio device body accommodating recess portion and the antenna accommodating recess portion are disposed back to back with each other; and further wherein a surface part of the antenna accommodating recess portion is a radio wave reflecting portion;

a base cover covering said radio device body accommodating recess portion of said base, and defining a radio device body accommodating portion accommodating said radio device body together with said base; and an antenna cover covering said antenna accommodating recess portion of said base, and defining an antenna accommodating portion accommodating said antenna together with said base;

a radio device body accommodated in said housing; and an antenna accommodated in said housing and connected to said radio device body.

2. The radio apparatus according to claim 1, wherein said housing further comprises:

a radio wave leakage preventing portion for preventing reflected radio waves from leaking in a direction of both sides of said housing, the reflected radio waves being reflected by the radio wave reflecting portion of the base among radio waves transmitted from said antenna.

3. The radio apparatus according to claim 2, wherein said radio wave leakage preventing portion blocks a space provided between said antenna and said radio wave reflecting portion with a radio wave cutoff member for shutting off a radio wave reflected by said radio wave reflecting portion.

4. The radio apparatus according to claim 3, wherein the radio wave cutoff member is a radio wave cutoff rib formed in the radio wave reflecting portion of the base.

5. The radio apparatus according to claim 1, wherein the antenna cover is made of a radio wave transmissive material having weather-resistance.

6. The radio apparatus according to claim 1, wherein said antenna includes an antenna substrate, and wherein a distance maintaining member is provided in the antenna accommodating portion for maintaining a predetermined distance between the antenna substrate and the antenna cover.

7. The radio apparatus according to claim 6, wherein the distance maintaining member is accommodated in the antenna accommodating portion in a state in which the antenna substrate is sandwiched between a first spacer, provided between the base and the antenna substrate, and a second spacer, provided between the antenna substrate the antenna cover, wherein a radio wave cutoff rib is provided in said housing, and an electrically conductive cushion member is provided on the radio wave cutoff rib, and the electrically conductive cushion member is abutted against the antenna substrate.

8. The radio apparatus according to claim 7, wherein a surface portion of the antenna cover is formed as a part of a sphere, and wherein an antenna cover facing surface portion of the second spacer is formed as a spherical portion that abuts against the surface portion of the antenna cover.

9. The radio apparatus according to claim 8, wherein a plurality of projections are formed on the antenna cover facing surface portion of the second spacer.

10. The roadside radio apparatus according to claim 1, wherein the base includes:

a first peripheral wall portion having a base-side mating part;

a screw hole portion disposed at a place that is more inward than the first peripheral wall portion; and a packing receiving portion disposed at a place that is more inward than the screw hole portion, and wherein the antenna cover includes:

a peripheral wall portion having an antenna-cover-side mating portion aligned with the base-side mating portion of the base when attached to the base;

screw seat portions disposed at a place which is more inward than the second peripheral wall portion; and a packing holding portion disposed at a place which is more inward than the screw seat portions, and wherein a waterproof packing is provided in the packing receiving portion of the base, and, in a state in which the antenna cover is attached to the base by aligning the antenna-cover-side mating portion with the base-side mating portion and by screwing screw members inserted into the screw seat portions, and the antenna accommodating portion is shut off from the outside by holding the waterproof packing with the packing holding portion.

11. The radio apparatus according to claim 1, wherein an air escape hole is provided in a surface portion of the base cover, wherein a porous waterproof sheet is provided by being stretched in the air escape hole, wherein a mounting seat element is fixed to a front side of the surface portion of the base cover, and a notch portion is provided in the mounting seat element, and the air escape hole is placed in the notch portion, wherein a mounting plate is fixed to the mounting seat element, and wherein a space provided just above the air escape hole is closed by the mounting plate.

12. The radio apparatus according to claim 1, wherein a recess portion is provided in a surface portion of the base cover, and a bottom part of the recess portion includes an LED display window portion for checking whether or not an LED of a radio device body accommodated in the radio device body accommodating portion, is turned on, and wherein the LED display window is covered with a transparent panel.

* * * * *